US005558214A

United States Patent [19]

Brundidge

[11] Patent Number: 5,558,214

[45] Date of Patent: Sep. 24, 1996

[54] BABY BOTTLE CARRIER

[76] Inventor: Jackie L. Brundidge, 19414 Ridgewood, Warrensville Heights, Ohio 44122

[21] Appl. No.: 433,094

[22] Filed: May 3, 1995

[51] Int. Cl.[6] ..... B65D 71/00

[52] U.S. Cl. ..... 206/162; 206/428; 206/549; 220/523

[58] Field of Search ..... 206/541, 542, 206/545, 546, 549, 427, 162, 161, 139, 203, 428; 220/523–526; 383/99

[56] References Cited

U.S. PATENT DOCUMENTS

| | | | |
|---|---|---|---|
| 1,698,489 | 1/1929 | Bickford | 206/162 |
| 2,555,126 | 5/1951 | Greve | 206/545 |
| 2,555,788 | 6/1951 | Donaldson | 206/549 |
| 2,724,494 | 11/1955 | Graff | 206/545 |
| 3,217,771 | 11/1965 | Skirow et al. | 220/513 |
| 3,589,594 | 6/1971 | Fischlein et al. | 383/99 |
| 4,228,908 | 10/1980 | Tweeton | 206/545 |
| 4,877,128 | 10/1989 | Strickland . | |
| 4,932,527 | 6/1990 | Hayes | 206/541 |
| 5,005,759 | 4/1991 | Bouche | 206/446 |
| 5,234,143 | 8/1993 | Mahvi et al. . | |
| 5,263,806 | 8/1966 | Ring | 206/427 |
| 5,313,807 | 5/1994 | Owen . | |
| 5,316,160 | 5/1994 | Cautereels . | |

*Primary Examiner*—Jimmy G. Foster
*Attorney, Agent, or Firm*—Howard M. Cohn

[57] ABSTRACT

A baby bottle carrier is constructed of a container with a plurality of interconnected compartments having a complementary cross section and shape corresponding to a bottle adapted to being received therein. A lid, detachably mounted to the container, closes each of the compartments. Cup shaped spacers are detachably secured to an underside of the lid to project into the compartments and abut against baby bottles of various sizes to insure that they are securely held in place, even when the carrier is moved from one location to another. Further in accordance with the invention, the baby bottle carrier is placed within a flexible closable bag with a shoulder strap and outwardly folding flap to close the bag.

17 Claims, 3 Drawing Sheets

BABY BOTTLE CARRIER

FIELD OF THE INVENTION

This invention relates to the field of bottle transport devices and more particularly, to a device to carry and store baby bottles which can be quickly and easily reconfigured to securely store baby bottles of different sizes within the compartments of the device. The invention also relates to a carrying bag in which the device to carry and store baby bottles can be inserted for ease of transport.

BACKGROUND OF THE INVENTION

The use of caddy devices of various types for transporting articles is well-known. One of the problems associated with carrying a number of baby bottles, which is often necessary when traveling or taking the baby to a location other than their own home, is to prevent the bottles within the caddy device from shifting around in the carrier, making the carrier less wieldy and increasing the chances that the bottles will break or leak. Also, there is a need for a small, compact, efficient, light-weight container for storing a number of different sized bottles and being able to place them, all at one time, into a refrigerator or cooler. It is also important to be able to move the bottle carrier with the different sized bottles as a unit in a carrying bag.

OBJECTS AND SUMMARY OF THE INVENTION

It is an object of the present invention to provide a device to carry and store baby bottles which can be changed so that baby bottles of various sizes can be securely stored and carried to obviate the problems and limitations of the prior art devices.

It is a further object of the present invention to provide a device to carry and store baby bottles which allows for quick and easy mounting and dismounting of spacers to a lid of the device to secure bottles of various sizes within compartments in the device.

Yet another object is to provide a device to carry and store a plurality of baby bottles that can be inserted within a carrying bag for ease of transport.

Still another object is to provide a device to carry and store baby bottles which can be constructed of lightweight, plastic material.

In accordance with the invention, there is provided a baby bottle carrier constructed of a container with a plurality of interconnected compartments having a complementary cross section and shape corresponding to a bottle adapted to being received therein. A lid, detachably mounted to the container, closes each of the compartments. Cup shaped spacers are detachably secured to an underside of the lid to project into the compartments and abut against baby bottles of various sizes to insure that they are securely held in place, even when the carrier is moved from one location to another.

According to the invention, the lid has a plurality of protrusions each for detachably mounting one of the spacers. When the lid is closed on the container, either the protrusions or the spacers project into the individual compartments to abut against a baby bottle disposed in any particular compartment.

Further according to the invention, the baby bottle carrier is used in combination with a flexible enclosure shaped to receive the baby bottle carrier and formed as a closable bag with a shoulder strap and outwardly folding flap to close the enclosure.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
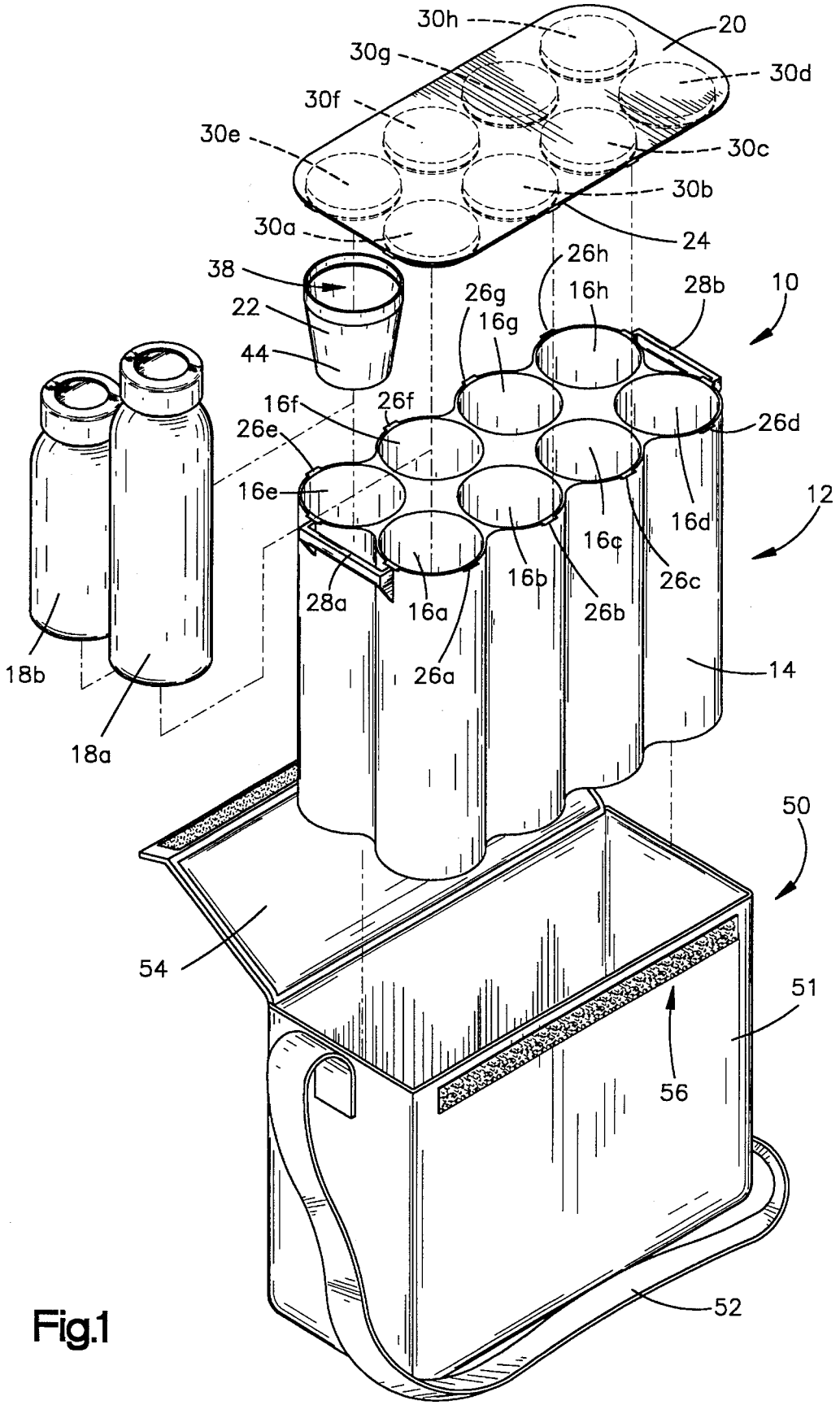
FIG. 1 is an exploded isometric view of the bottle carrier container, lid, and carrying bag in accordance with the invention.
Figure 2:
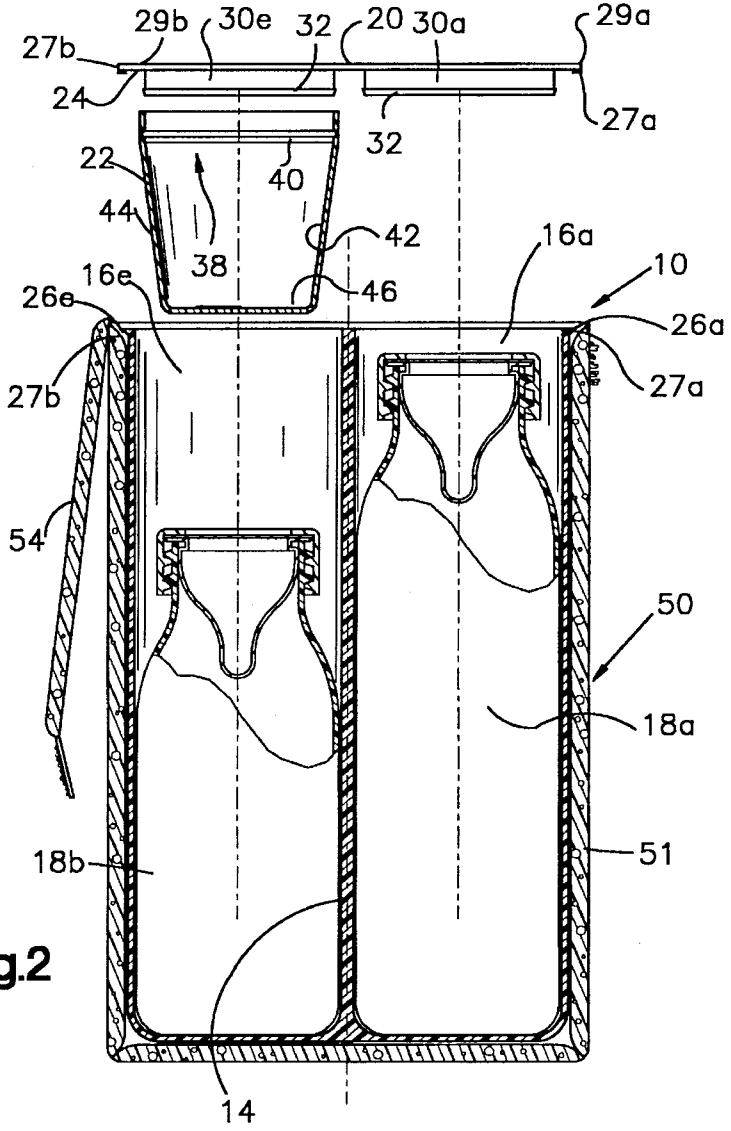
FIG. 2 is a cross sectional view of a first embodiment of the bottle carrier container and lid, illustrating the lid and a snap on spacer and the bottle carrier in a closable bag.

With reference to the drawings, and particularly to FIGS. 1 and 2, a new and improved baby bottle carrier and in combination with a flexible enclosure embodying the principles and concepts of the present invention and generally designated by the reference 10 will be described.

More specifically, it will be noted that the baby bottle carrier 12 includes a container 14 having a plurality of interconnected compartments **16*a*–16*h*, each adapted to receive a baby bottle, typically of two sizes, for example an eight ounce bottle 18*a* and a four ounce bottle 18*b*. As shown in FIG. 1, the eight ounce bottle 18*a* is generally of the same diameter but longer than four ounce bottle 18*b*. A lid 20 is detachably mounted to container 14 to close each of the compartments 16*a*–16*h*. Spacers 22 are detachably secured to the underside 24 of the lid so as to project into the compartments 16*a*–16*h* and abut against the smaller baby bottles 18*b***, which are received within a compartment.

Container 14, as shown in FIG. 1, can be formed of any number of interconnected compartments **16*a*–16*h* which preferably have a complementary cross section and shape to bottles 18*a* or 18*b*. Typically, the cross section is circular but it may be hexagonal or octagonal to conform to the shape of certain baby bottles. While the container 14 is illustrated with eight interconnected compartments 16*a*–16*h*, it is within the terms of the invention to use any number of compartments such as four, six or ten. The opened upper end of the compartments which are adapted to insert bottles 18*a* and 18*b*, can be formed with a plurality of outwardly projecting ridges 26*a*,26*b*,26*c*,26*d*, 26*e*,26*f*,26*g*,26*h* (26*a*–26*h*) that are adapted to frictionally engage either of lips 27*a* or 27*b* which extend along the opposite longitudinal edges 29*a* and 29*b*, respectively, of lid 20 so as to close each of the compartments 16*a*–16*h* of the container 14, as discussed in more detail below. The specific means of mounting the lid 20 to the container 14 can also include other means such as a groove (not shown) about the periphery of the lower surface 24 of lid 20 into which the ridges (26*a*–26*h*) or other protrusions from the edge of the container 14** can be inserted.

A pair of handle loops 28*a* and 28*b* are mounted onto the exterior surface of the opposite ends of container 14, preferably near the open end of the compartments 16*a*–16*h* and are adapted to attach a shoulder strap (not shown) to carry the container by itself. While a pair of handle loops are illustrated, it is also within the terms of the invention to substitute other means, such as for example, hooks or button shaped projections to attach the shoulder strap as desired. Typically, carrier 14, lid 20, and spacers 22 are constructed of a lightweight, relatively rigid plastic material which is washable and easy to clean.

Figure 4:
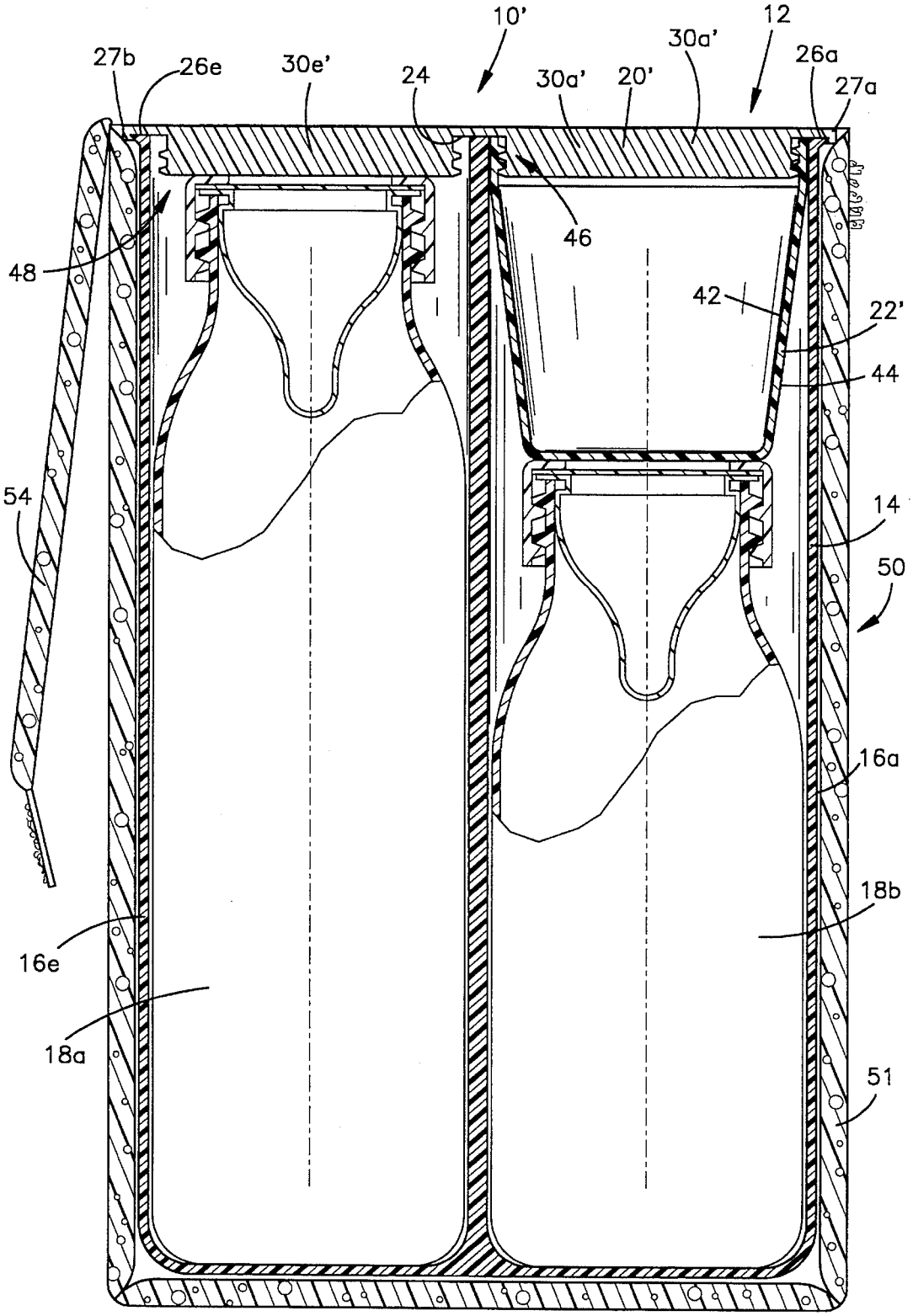
FIG. 4 is a side cross sectional view of the lid snapped onto the bottle carrier with the baby bottles in the compartments and the bottle carrier in a closable bag.

A principle feature of this invention is the construction of lid 20 which is detachably mounted to container 14 so as to close all of the compartments 16*a*–16*h*. The underside 24 of lid 20 has a plurality of protrusions 30*a*,30*b*,30*c*,30*d*,30*e*, 30*f*,30*g*,30*h* (30*a*–30*h*) aligned to extend within compartments 16*a*–16*h* whenever lid 20 is mounted onto container 14 so as to close the compartments. As shown in FIG. 2, each of the protrusions 30*a*–30*h* are substantially cylindrical in shape and contain means for detachably mounting a spacer 22. For example, in FIG. 2, protrusions 30*a*–30*h* have a shoulder 32 extending outward from the free end for detachably mounting a spacer 22 as discussed in more detail below. As shown in FIG. 4, the protrusions 30*a*–30*h* extend outwardly from the lid 20 so that when the lid is mounted onto the container 14 so as to close each of the compartments 16*a*–16*h*, the protrusions 30*a*–30*h* extend into the compartments a distance so as to abut against the top of a large baby bottle 18*b* so as to secure it into place. For ease of assembly, it may be desirable to construct the protrusions 30*a*–30*h* with a taper so that they can easily be inserted into the compartments 16*a*–16*h*. It is also within the terms of the invention to form the base of protrusions 30*a*–30*h* of a size so that they will frictionally engage the interior walls of compartments 16*a*–16*h* when the lid 20 is attached to the container 14 to secure lid 20 in place. While the lid 20 can be completely detachable from container 14, it is also in the terms of the invention to attach the lid to the container 14 by means such as resilient elbows (not shown) so that the lid remains attached to container 14 even when it is open.

Another principle feature of this invention is the construction of spacers 22 which are detachably mounted to protrusions 30*a*–30*h*. The spacers 22 are cup-shaped and have a means 38 within the interior surface 42 for securing the spacers 22 to the protrusions 30*a*–30*h*. Means 38 can include a groove 40 formed in the inner surface 42 to engage a shoulder 32 of any protrusion to secure one of the spacers 22 thereto. Typically, the outer surface 44 of the spacers are slightly tapered toward their closed end 46 so that they can easily be inserted within the compartment 16*a*–16*h* when the lid 20 is closed against the container 14.

Figure 3:
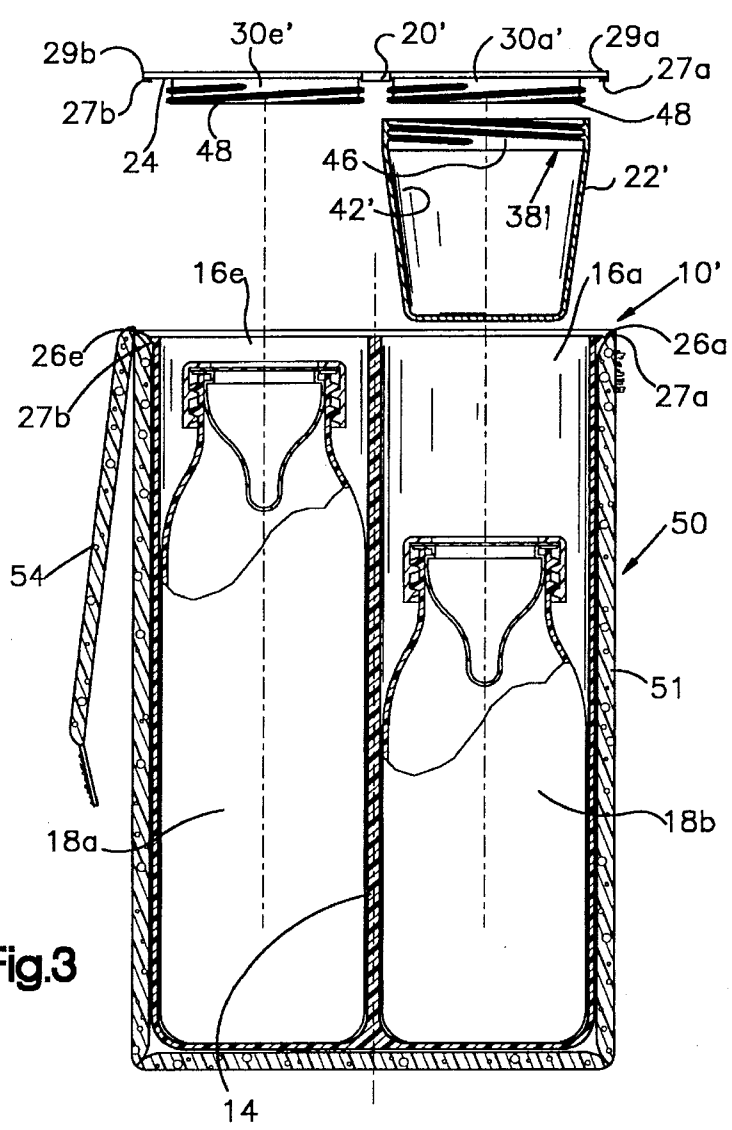
FIG. 3 is a cross sectional view of a second embodiment of the bottle carrier container and lid, illustrating the lid and a threaded on spacer and the bottle carrier in a closable bag.

In a second embodiment of the baby bottle carrier and enclosure 10', as shown in FIGS. 3 and 4, means 38' for securing the spacers 22' to the protrusions 30*a'*–30*h'* of lid 20' include a threaded section 46 on the interior surface 42' of spacers 22' which engages the threaded section 48 of protrusions 30*a'*–30*h'* respectively Throughout the specification, primed numbers represent structural elements which are substantially identical to structural elements represented by the same unprimed number.

A further principle aspect of the invention relates to a flexible enclosure 50 shaped to receive the baby bottle carrier 12. The flexible enclosure 50 is formed as a closable bag 51 with a shoulder strap 52 and has an outwardly folding flap 54 to close the enclosure. The folding flap can be secured by conventional means 56 such as Velcro patches or a zipper. While bag 51 is illustrated with a single flap 54, it is also within the scope of the invention to use two or more flaps as desired. Further, while strap 52 is illustrated as being affixed to bag 51, it is also within the terms of the invention to removably attach strap 52 to bag 51 so that it can be easily removed and secured to handle loops 28*a*–28*b* to carry the container 14.

It is apparent that there has been provided in accordance with this invention a device to carry and store baby bottles which can be configured so that baby bottles of various sizes can be securely stored and carried that satisfy the objects, means and advantages set forth hereinbefore. According to the invention, there is provided a baby bottle carrier constructed of a container with a plurality of interconnected compartments having a complementary cross section and shape corresponding to a bottle adapted to being received therein. A lid, detachably mounted to the container, closes each of the compartments. Cup shaped spacers, detachably secured to an underside of the lid, project into the compartments and abut against baby bottles of various sizes to insure that they are securely held in place, even when the carrier is moved from one location to another. Further in accordance with the invention, the baby bottle carrier is used in combination with a flexible closable bag with a shoulder strap and outwardly folding flap to close the bag.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. A baby bottle carrier, comprising:

a container provided with a plurality of interconnected compartments each adapted to receive baby bottles of various sizes;

a lid detachably mounted to said container to close each of said compartments and having a plurality of protrusions; and a plurality of spacers each detachably secured to an underside of said lid by one of said plurality of protrusions of said lid to project into said compartments and abut against said baby bottles of various sizes.

2. The baby bottle carrier of claim 1 wherein said spacers are threadely secured to said protrusions.

3. The baby bottle carrier of claim 1 wherein said protrusions project into said compartments to abut against certain of said baby bottles.

4. The baby bottle carrier of claim 1 wherein said container has a pair of handle loops adapted to attach a strap to carry said container.

5. The baby bottle carrier of claim 1 wherein said interconnected compartments of said container have a complementary cross section and shape to said baby bottles.

6. The baby bottle carrier of claim 1 wherein said lid is hingedly mounted to said container.

7. The baby bottle carrier of claim 1 wherein said interconnected compartments of said container have a circular cross section.

8. The baby bottle carrier of claim 1 wherein said container has eight interconnected compartments.

9. The baby bottle carrier of claim 1 wherein said container, said spacers, and said lid are constructured of a lightweight, plastic material.

10. The baby bottle carrier of claim 9 wherein said container and said lid are constructured of a lightweight, rigid, plastic material.

11. The baby bottle carrier of claim 1 wherein said protrusions are cylindrical and have a shoulder extending outward from the free end for detachably mounting one of said spacers.

12. The baby bottle carrier of claim 11 wherein said spacers are cup shaped and have a groove formed in the inner surface for snapping onto said shoulder of said protrusions.

13. The baby bottle carrier of claim 1 wherein said spacers are cup shaped.

14. The baby bottle carrier of claim 1 wherein said protrusions are cylindrical and have a threaded section extending outward from the free end for detachably mounting one of said spacers.

15. The baby bottle carrier of claim 14 wherein said spacers are cup shaped and have a threaded portion formed in the inner surface of the cup shaped spacers for threadedly mounting onto said threaded section of said cylindrical protrusions.

16. The baby bottle carrier of claim 1 in combination with a flexible enclosure shaped to receive said baby bottle carrier.

17. The baby bottle carrier of claim 16 wherein said flexible enclosure is formed as a closable bag with a shoulder strap and outwardly folding flaps to close said enclosure.

* * * * *